US005853316A

United States Patent [19]

Kern et al.

[11] Patent Number: 5,853,316

[45] Date of Patent: Dec. 29, 1998

[54] METHOD OF AND APPARATUS FOR GRINDING CONTROL EDGES OF A CONTROL BUSH

[75] Inventors: Ludwig Kern, Erlangen; Andre Kuckuk, Herzogenaurach; Paul Katona, Weisendorf, all of Germany

[73] Assignee: INA Wälzlager Schaeffler oHG, Herzogenaurach, Germany

[21] Appl. No.: 874,052

[22] Filed: Jun. 12, 1997

Related U.S. Application Data

[63] Continuation of Ser. No. 541,787, Oct. 10, 1995, abandoned.

[30] Foreign Application Priority Data

Oct. 19, 1994 [DE] Germany ..... 44 37 302.3

[51] Int. Cl.[6] ..... B24B 5/00

[52] U.S. Cl. ..... 451/11; 451/6; 451/51; 451/178; 451/246; 451/252

[58] Field of Search ..... 451/6, 10, 11, 451/51, 54, 178, 231, 242, 246, 249, 252, 398, 402, 405

[56] References Cited

U.S. PATENT DOCUMENTS

| | | | |
|---|---|---|---|
| 2,899,778 | 8/1959 | Bricker et al. | 451/249 |
| 3,147,573 | 9/1964 | Flohr, Jr. | 451/249 |
| 3,854,252 | 12/1974 | Lindsay et al. | 451/242 |
| 4,201,016 | 5/1980 | Kirk et al. | 451/249 |
| 4,376,356 | 3/1983 | Everett | 451/231 |
| 4,441,280 | 4/1984 | Wetzels et al. | 451/242 |
| 4,480,412 | 11/1984 | Shank et al. | 451/246 |
| 4,586,295 | 5/1986 | Ishii | 451/242 |
| 4,679,358 | 7/1987 | Sieradzki | 451/6 |
| 4,693,038 | 9/1987 | Vetter | 451/6 |
| 4,783,932 | 11/1988 | Sager | 451/242 |
| 4,936,603 | 6/1990 | Frost . | |
| 5,371,975 | 12/1994 | Lundmark | 451/6 |
| 5,413,522 | 5/1995 | Husson | 451/6 |
| 5,538,459 | 7/1996 | Gottschald et al. | 451/11 |

FOREIGN PATENT DOCUMENTS

| | | |
|---|---|---|
| 40 31 559 A1 | 4/1992 | Germany . |
| WO 92 10 334 | 6/1992 | WIPO . |

*Primary Examiner*—Eileen P. Morgan
*Attorney, Agent, or Firm*—Henry M. Feiereisen

[57] ABSTRACT

A method of grinding control edges of a control bush of a rotary slide valve for hydraulic steering of motor vehicles, includes placement of the control bush in a support in form of slide shoes or a V block and additionally securing the control bush in the support by pressure rollers. A precise angular positioning of the control bush is effected by press-fitting a mandrel into the interior of the control bush. After grinding the control bush to a predetermined outside diameter, the reference points commensurate with the angular position of the individual control edges are determined by a measuring system. Based on the determined reference points, an optimum reference point for the angular position of all control edges is computed and utilized for adjusting the mandrel in form of a zero point shift for grinding the control edges.

7 Claims, 4 Drawing Sheets

METHOD OF AND APPARATUS FOR GRINDING CONTROL EDGES OF A CONTROL BUSH

This is a continuation of application Ser. No. 08/541,787, filed Oct. 10, 1995 now abandoned.

BACKGROUND OF THE INVENTION

The present invention refers to a method and apparatus for making a control bush, and in particular for centerless grinding control edges of a control bush of a rotary slide valve for hydraulic steering of motor vehicles.

It is generally known that an increasing load of the steered axle necessitates an increased force required to direct the road wheels. In order to facilitate a steering operation, servo-assisted steering systems are installed by which an auxiliary power source assists the driver by providing the major force for effecting the steering operation. Such a power steering mechanism is of hydraulic nature in propelled vehicles, and is effected by hydraulic pressure from an engine-driven pump that acts on a control valve which is connected to the steering column. An example for such a control valve is a rotary slide valve. As major components, such a rotary slide valve includes a rotary slide member and a control bush, with the rotary slide member being formed with grooves and the control bush being formed with grooves and additional control edges. A rotary slide valve of this type is generally known from a publication released by Zahnradfabrik Friedrichshafen, entitled ZF-Zahnstangen-Hydrolenkungen, G 7830 P-WA 2/91 d, 1991.

A drawback of such a rotary slide valve is the very cumbersome and complex machining requirements for making the control bush. The control bush is made from a blank of solid material through turning or milling. Subsequently, the blank is diametrically ground, followed by a grinding of the grooves and the control edges, with the angular orientation of the control edges being effected by providing a ground reference surface or by holding the workpiece in a chuck during machining.

SUMMARY OF THE INVENTION

It is an object of the present invention to provide an improved method of and apparatus for making a control bush obviating the afore-stated drawbacks.

In particular, it is an object to provide an improved method of and apparatus for making a control bush, by which the production costs are minimized through reduction of required machining steps.

These objects and others which will become apparent hereinafter are attained in accordance with the present invention by grinding a control bush exhibiting a predetermined outer diameter in a support, with the control bush additionally secured by a suitable pressure-exerting unit, and with the angular position of the control bush being effected by a mandrel that is press-fitted in an untreated surface of the control bush, determining a reference point of the angular position of each individual control edge by a measuring system, computing from the separately determined reference points an optimum reference point for the angular position of all control edges, and grinding the control bush for formation of the control edges commensurate with the computed optimum reference point.

Preferably, the outer diameter of the control bush is ground by centerless grinding.

A suitable pressure-exerting unit can be a pressure roller that bears upon the control bush to securely hold it in place during machining operation. However, any pneumatic, magnetic or hydrostatic means may also be employed to effect a secure holding of the control bush in place.

Advantageously, an optical system is used as measuring system for determining a reference point of the angular position of each individual control edge.

The method according to the present invention has the advantage that the actual machining operation is reduced to two working steps, that is the grinding of the outer diameter of the control bush through centerless grinding and the actual grinding of the control edges once the accurate angular position of the grooves is determined. Through centerless grinding, same diameter tolerances are accomplished as through grinding between centers. For grinding the control edges, the control bush is received in slide shoes or in a V block in order to ensure a high precision without necessitating a repeated grinding of the outer diameter. As the magnetic chuck, that is typically utilized in slide shoe grinding, does not permit a precise angular positioning of the control bush because of the slip at the driver, the angular positioning, i.e. the rotational motion of the control bush, is effected by a mandrel that is press-fitted into the interior of the control bush. Since a shift between the axis of the workpiece (control bush) and the axis of the mandrel would result in deviations, the relative movement must be minimized. This is attained, in accordance with the present invention, by additionally securing the control bush in place within the slide shoe or V block by pressure rollers.

The control edges are ground by interpolation between the mandrel axis and the feed axis. The high demand for precision (pitch errors) requires that the point of reference for the angular position of the control edges must be determined separately for each part. For that, it is necessary to determine the angular position of the grooves, thus necessitating a measuring system that allows determination of all eight grooves within a short period. Examples for such a measuring system include an optical sensor which cooperates with a respective electronic evaluation system for associating a precise angular position of the mandrel to each groove. The evaluation system automatically calculates from the values inputted by the measuring system commensurate with the angular position of the grooves the optimum point of reference for the angular position of the control bush and thus precise position of the control edges by suitably turning the mandrel (zero point of the mandrel axis).

The process according to the present invention affords a particular cost-efficient and simple manufacture of the control bush.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 2:
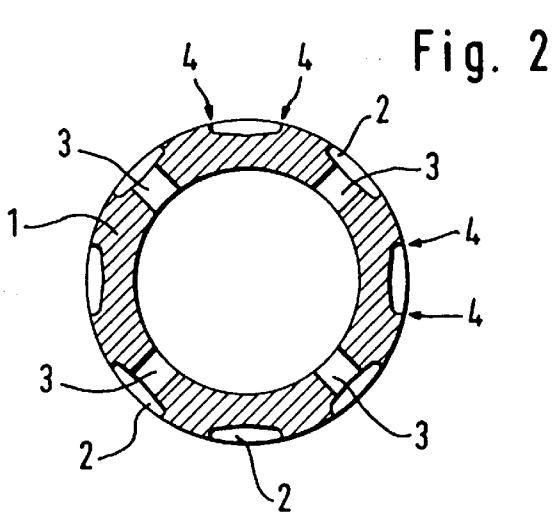
FIG. 2 is a sectional view of the control bush taken along the line II—II in FIG. 1.

Throughout all the Figures, the same or corresponding elements are always indicated by the same reference numerals.

Figure 1:
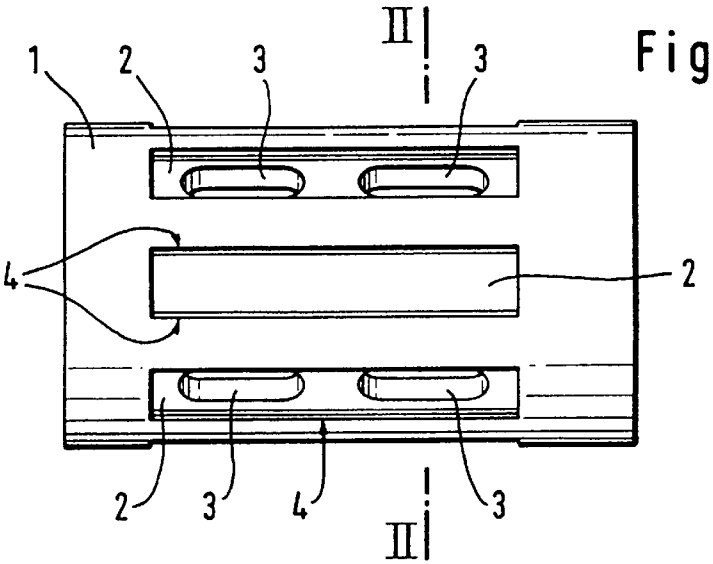
FIG. 1 is a plan view of a control bush.

Turning now to the drawing, and in particular to FIG. 1, there is shown a plan view of a control bush 1 for use in a rotary slide valve for hydraulic auxiliary power steering. The control bush 1 is configured in form of a cylindrical hollow body with eight grooves 2 evenly spaced about the circumference thereof. As shown in particular in FIG. 2, which is a sectional view of the control bush 1 taken along the line II—II in FIG. 1, four of these grooves 2, i.e. every other groove 2, are provided with radial bores 3 that are connected to the interior of the control bush 1 for supply and discharge of oil for the hydraulic steering mechanism. Reference numeral 4 designates control edges by which the flow rate of oil is regulated in dependence from the angle of rotation of the control bush 1.

It will be appreciated by persons skilled in the art that the rotary slide valve must contain much mechanical apparatus which does not appear in the foregoing Figures. However, this apparatus, like much other necessary apparatus, is not part of the present invention, and has been omitted from the Figures for the sake of simplicity. Additionally, persons skilled in the art will understand that the rotary slide valve is adapted for use with a hydraulic auxiliary steering mechanism that has also been omitted from the Figures for the sake of simplicity since it is not part of the present invention.

Figure 7:
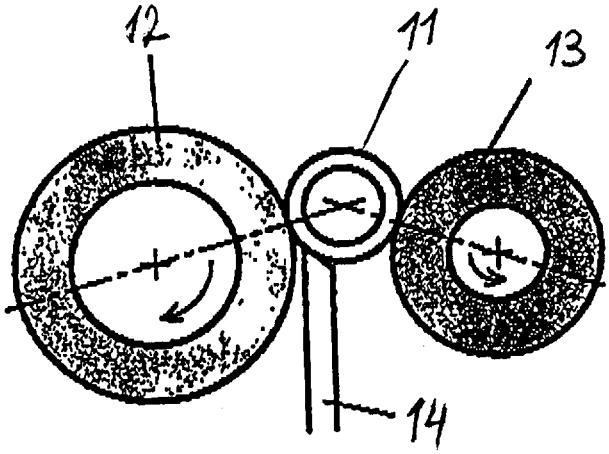
FIG. 7 is a schematic illustration of a typical centerless grinding unit.

In order to make the control bush 1 with precisely positioned control edges 4, a blank for a control bush 1 that is formed with grooves 2 and bores 3 is ground in an initial step through centerless grinding to a predetermined outer diameter, with the diametrical reduction ranging in the magnitude of 200 to 300 $\mu$m. Centerless grinding is effected by carrying the blank 11 between a grinding wheel 12 and a control wheel 13 on a support rail 14, as shown in FIG. 7 by way of example only. Through suitable alignment or inclination of the control wheel relative to the grinding wheel, an axial component is generated by which the blank (control bush 1) is advanced between the grinding wheel and the control wheel in axial direction.

Figure 4:
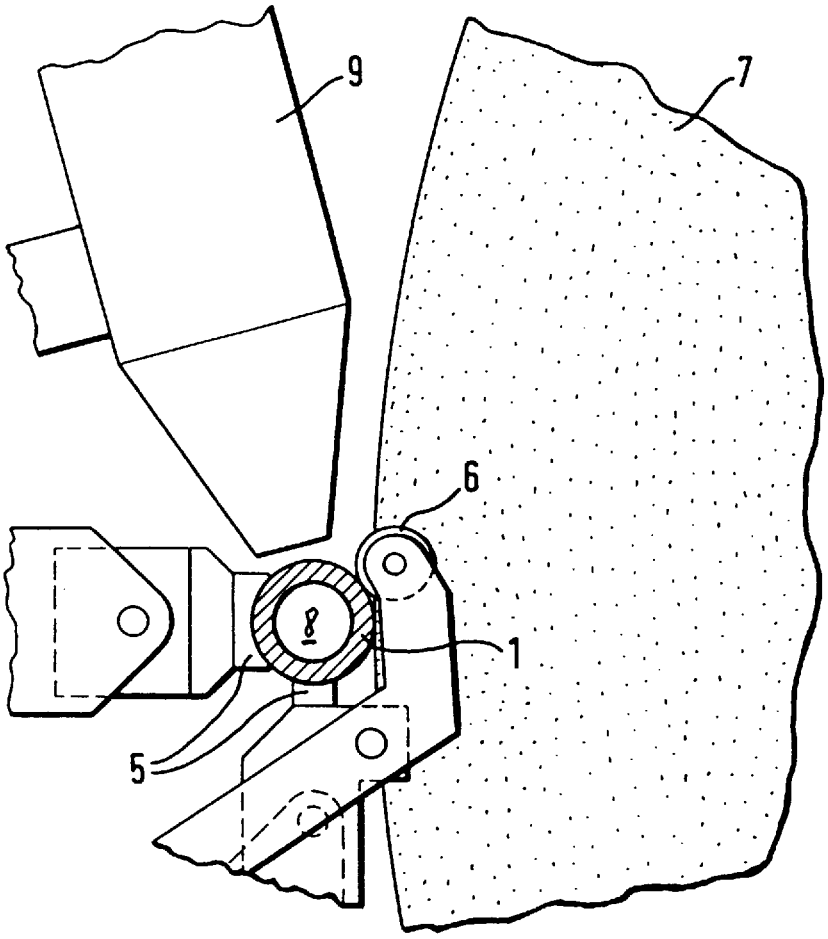
FIG. 4 is a partially sectional side view of an apparatus for machining a control bush, showing in detail a slide shoe arrangement for supporting the control bush.

The actual grinding of the control edges 4 is effected with the control bush 1 being received in a support in form of two slide shoes 5 arranged at a right angle to each other, as shown in FIG. 4. Instead of slide shoes 5, the support may also be provided in form of a V block. As the magnetic chuck typically utilized in slide shoe grinding does not allow a precise angular position because of the slip at the driver, a mandrel 8 is press-fitted in the interior of the control bush 1 to effect a precise angular position of the grooves 2. The mandrel 8 is suitably formed with passageways that communicate with the bores 3 for conducting oil. In order to ensure that the control bush 1 is securely held in place and precisely coaxially aligned during grinding operation, additional pressure rollers 6 are positioned at axial ends of the control bush 1 to bias the control bush 1 in direction of the slide shoes 5, as shown in FIG. 5.

Figure 3:
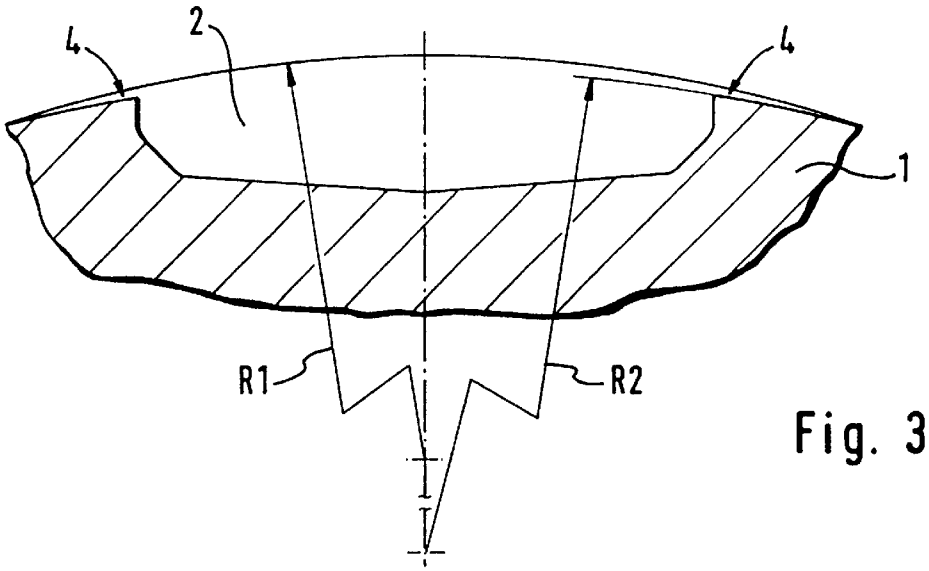
FIG. 3 is a fragmentary, sectional view, on an enlarged scale, of the control bush, illustrating in detail the area of a groove.
Figure 5:
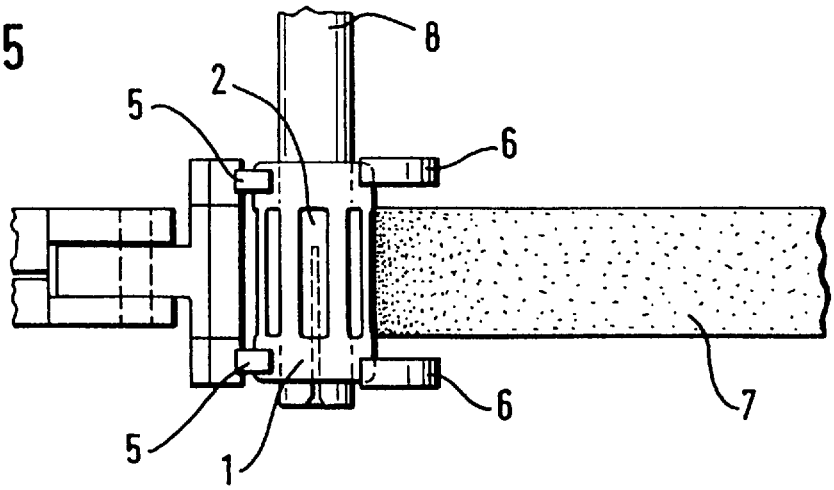
FIG. 5 is a front view of the apparatus of FIG. 4.
Figure 6:
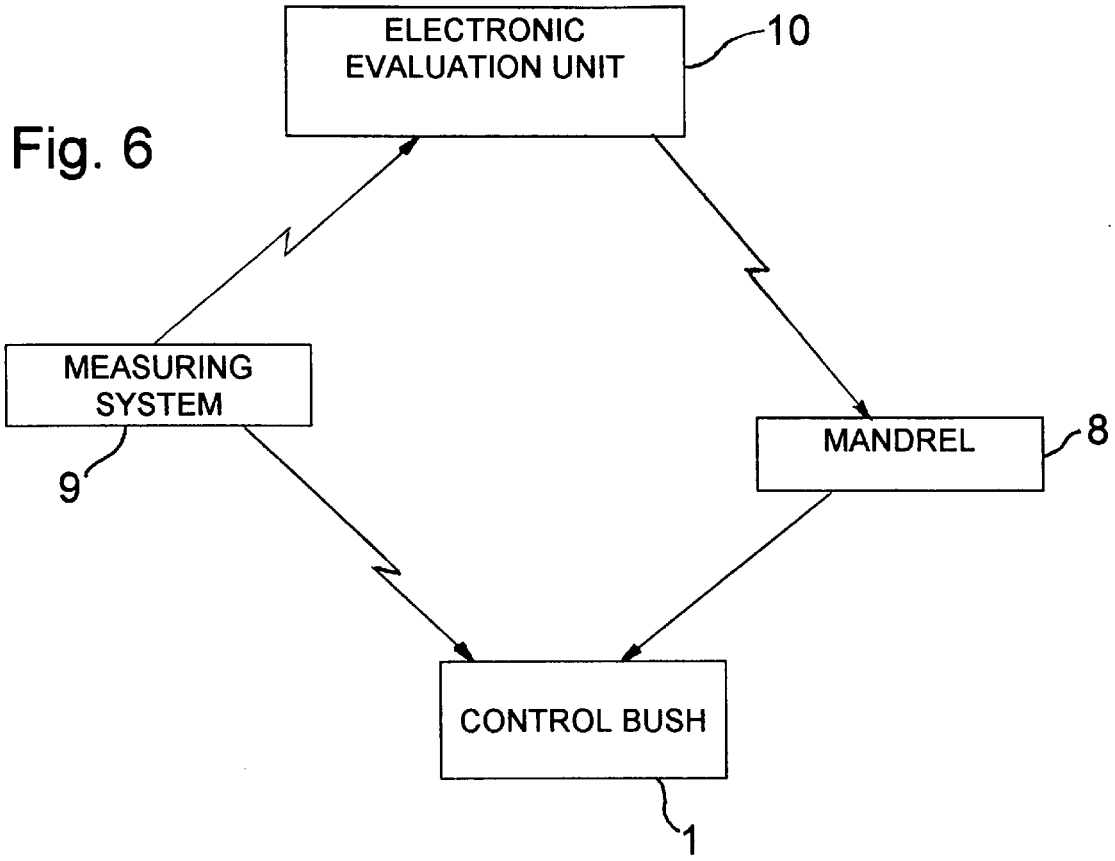
FIG. 6 is a schematic block diagram showing cooperation between various components of a preferred embodiment.

The control edges 4 are ground by a grinding wheel 7, that has a same width as the grooves 2 (FIG. 5). In order to satisfy the high demand for precision, the angular position of the grooves 2 is accurately determined by an optical measuring system 9 which determines through triangulation the precise distance from the respective measuring point, i.e. from the respective control edge 4. Triangulation is a surveying method which is based on a network of connected triangles by utilizing the radii R1 and R2, as shown in FIG. 3. The optical measuring system 9 forms a signal commensurate with a point of reference for the angular position of each control edge 4 and transmits all thus formed signals to an electronic evaluation unit 10 for associating a precise angular position of the mandrel 8 to each groove 2. As shown in FIG. 6, the evaluation unit 10 computes from all signals inputted by the measuring system 9 a mean value which represents an optimum point of reference for the angular position of the control edges 4, i.e. for the zero point of the mandrel axis with the mandrel 8 being turned in accordance with the executed computation in order to advance the control bush 1 from one angular position to another angular position for grinding the control edges 4. The evaluation unit 10 considers the determined value in form of a zero shift for grinding of the control edges 4.

While the invention has been illustrated and described as embodied in a method of and apparatus for grinding control edges of a control bush, it is not intended to be limited to the details shown since various modifications and structural changes may be made without departing in any way from the spirit of the present invention.

What is claimed as new and desired to be protected by Letters Patent is set forth in the appended claims:

1. A method of positioning a control bush of a rotary slide valve for hydraulic steering of motor vehicles for subsequent centerless grinding of control edges of the control bush, comprising the steps of:

providing a control bush having a predetermined outside diameter and formed with a plurality of circumferentially spaced grooves bound by edges to be ground for formation of control edges of the control bush;

placing a mandrel interiorly in the control bush in a form-fitting manner for adjusting an angular position of the control bush;

determining a reference point of the angular position of each individual groove of the control bush by a measuring system;

computing from the determined reference points of all grooves an optimum reference point for the angular position of the control edges; and positioning the grooves of the control bush for formation of the control edges through subsequent grinding commensurate with the computed optimum reference point in accordance with a given angular pitch of the control edges.

2. The method of claim 1 wherein said step of determining the angular Position of the individual grooves is effected by an optical measuring system.

3. Apparatus for a control bush of a rotary slide valve for use in hydraulic steering of motor vehicles for subsequent centerless grinding of control edges of the control bush, comprising:

support means for securely holding a control bush that defines an interior space and is formed with a plurality of circumferentially spaced grooves bound by edges to be ground for formation of control edges of the control bush;

grinding means including a grinding wheel for machining the control bush;

a mandrel press-fitted in the interior space of the control bush for adjusting an angular position of the control bush in relation to the grinding wheel;

measuring means for determining a reference point of the angular position of said grooves and forming signals commensurate with each reference point being determined; and control means receiving the signals for calculating from the individual reference points an optimum reference point for positionally adjusting the mandrel and thereby setting the angular position of the grooves of the control bush for allowing formation of control edges through grinding in accordance with a given angular pitch of the control edges.

4. The apparatus of claim 3 wherein said support means includes a slide shoe.

5. The apparatus of claim 3 wherein said support means includes a pressure roller acting upon the control bush for additional securement thereof.

6. The apparatus of claim 3 wherein said grinding means includes a centerless grinding unit for grinding the control bush to a predetermined outer diameter.

7. The apparatus of claim 3 wherein said measuring means is an optical measuring system.

* * * * *